United States Patent [19]

Staggs et al.

[11] Patent Number: 4,461,362

[45] Date of Patent: Jul. 24, 1984

[54] MINING DRILL WITH APERTURES AND COLLARS PROVIDING FOR FLOW OF DEBRIS

[76] Inventors: Arnol Staggs; Margarita C. Flores, both of 1155 Lincoln St., Wyandotte, Mich. 48192

[21] Appl. No.: 427,427

[22] Filed: Sep. 29, 1982

[51] Int. Cl.[3] ..... E21B 17/10; E21C 9/00

[52] U.S. Cl. ..... 175/325; 175/406; 175/410

[58] Field of Search ..... 175/320, 325, 385, 401, 175/391, 406, 410, 408; 285/404; 308/4 A; 279/83

[56] References Cited

U.S. PATENT DOCUMENTS

| | | | |
|---|---|---|---|
| 1,770,207 | 7/1930 | Helmling | 308/4 A |
| 2,361,683 | 10/1944 | Greenberg | 279/83 |
| 2,495,073 | 1/1950 | Morris | 175/401 |
| 2,607,562 | 8/1952 | Phipps | 175/391 |
| 3,313,364 | 4/1967 | Binkley | 175/401 |
| 3,667,768 | 6/1972 | Stokey | 279/83 |
| 4,073,354 | 2/1978 | Rowley et al. | 175/391 |
| 4,099,585 | 7/1978 | Emmerich | 285/404 |

*Primary Examiner*—Ernest R. Purser
*Assistant Examiner*—Mark J. Del Signore
*Attorney, Agent, or Firm*—Basile, Weintraub & Hanlon

[57] ABSTRACT

A mining drill mountable in a holder of a drilling machine. The drill includes an elongated shaft having an internal bore extending longitudinally therethrough. A cutting bit is mountable on one end of the shaft and includes a cutting tip mounted at one end thereof and a plurality of cutting teeth disposed about its periphery. A partial longitudinal bore is formed in the cutting bit and is alignable with the bore in the shaft. An aperture is formed in the cutting bit in communication with the bore in the cutting bit to direct debris through the aperture into the aligned bores in the cutting bit and shaft. A collar is mounted on the shaft and has a downward-extending inclined top surface. At least one aperture is formed in the shaft adjacent to the collar in communication with the interior bore in the shaft to direct debris into the bore. A cutting edge is formed on the bottom of the collar.

11 Claims, 2 Drawing Figures

MINING DRILL WITH APERTURES AND COLLARS PROVIDING FOR FLOW OF DEBRIS

BACKGROUND OF THE INVENTION

1. Field of the Invention

This invention relates, in general, to mining tools and, more specifically, to mining drills and bits.

2. Description of the Prior Art

In the mining industry, Federal and State safety laws require that roof bolts be installed in the roof so as of each mine to provide support for the roof to prevent collapse or cave-in. The roof bolts generally comprise an elongated bolt having an expandible nut mounted at one end and a square plate mounted at the other end. The bolt is inserted into a hole drilled in the roof of the mine and the bolt is torqued to cause the nut to expand and anchor itself in the rock. The plate on the bottom of the bolt provides support for the roof of the mine to prevent collapse.

A variety of drills are commonly employed to form the holes in the roofs of mines. A typical drill has a cone-shaped head which removably receives a carbide insert or cutting bit and is formed to allow for removal of dirt and debris from the cutting area. The opposite end of the drill is inserted into a hollow bar which provides a means for rotating the bit. The bar, in turn, fits into a conventional drilling machine.

Such drills, while generally effective in forming holes in mine roofs which meet federal and state regulations for size tolerance and concentricity, are not without drawbacks. For one, it is not uncommon to have the bits undersized and the bars oversized which creates a misfit when the bit is inserted into the bar. During the drilling operation, the bit will wobble or move from side to side within the bar which imposes excessive force on the bit and leads to frequent breakage of the bit. In addition such movement often leads to a nonconcentric hole.

Another problem with previously devised mining drills used in mine roof operations arises when water is encountered during drilling. Under such conditions, the hole will shrink during drilling due to the pressure of the water which causes frequent breakage of the bit or separation of the bit from the bar within the hole. Further, the shrinkage leads to undersized holes which cannot receive the standard size roof bolt.

Thus, it would be desirable to provide a mining drill which overcomes the problems of previously devised mining drills. It would also be desirable to provide a mining drill which is particularly suited for use in forming holes in mine roofs. It would also be desirable to provide a mining drill which includes a bit and bar which can drill any depth hole and maintain close size tolerances and concentricity. Finally, it would be desirable to provide a mining drill which can maintain proper hole size under wet conditions.

SUMMARY OF THE INVENTION

There is disclosed herein a unique mining drill which is suitable for use in mine roof drilling operations. The mining drill includes an ellongated shaft having a longitudinal bore extending therethrough. A cutting bit is mountable on one end of the shaft and includes a cutting tip mounted at one end and a plurality of cutting teeth disposed about its periphery. A partial longitudinal bore is formed in the cutting bit and is alignable with the bore in the shaft. An aperture is formed in the cutting bit and communicates with the bore within the cutting bit to direct debris from the cutting area into the aligned bores in the cutting bit and shaft.

A collar is mounted on the shaft and has a downwardly extending, inclined top surface. At least one aperture is formed in the shaft in communication with the interior bore and is disposed adjacent to the collar to direct debris into the bore in the shaft. Alternately, a cutting edge is formed on the bottom surface of the collar to insure proper hole size tolerances and concentricity as the drill is removed from the hole.

In a preferred embodiment, a pair of apertures are formed in the cutting bit in communication with the bore in the cutting bit. Also, a plurality of vertically spaced pairs of collars and apertures are formed on the shaft to insure complete removal of debris from the cutting area through the interior of the shaft.

The mining drill of the present invention overcomes many of the problems encountered with previously devised mining drills. The mining drill of the present invention is particularly suited for drilling holes in mine roofs for mounting standard mine roof bolts therein. By securely mounting the cutting bit on a shaft, close hole size tolerances and concentricity are easily attained without the occurrence of bit movement which is commonly encountered with previously devised mining drills.

The unique provision of apertures in the cutting bit and along the shaft which communicate with aligned bores within the cutting bit and shaft operate to effectively remove dirt and debris from the cutting area so as to provide a highly effective drilling operation. Further, the provision of cutting means on the collars mounted on the shaft insures close hole tolerances and concentricity even under wet conditions.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
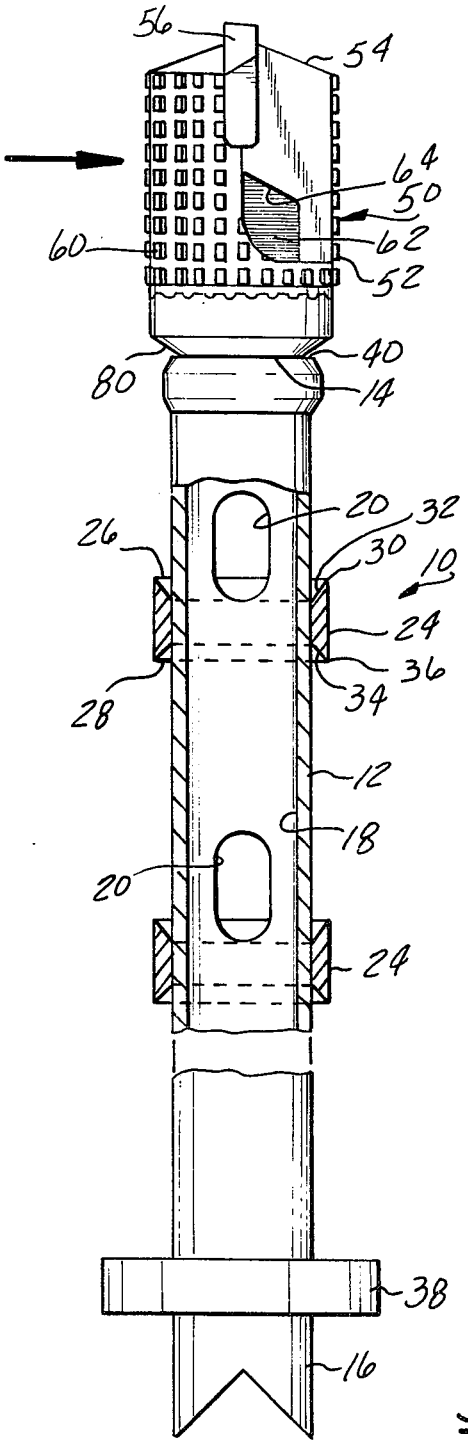
FIG. 1 is a partially broken away, elevational view of a mining drill constructed in accordance with the teachings of the present invention.

Throughout the following description and drawing, the same reference number is used to identify the same component shown in the multiple figures of the drawing.

Figure 2:
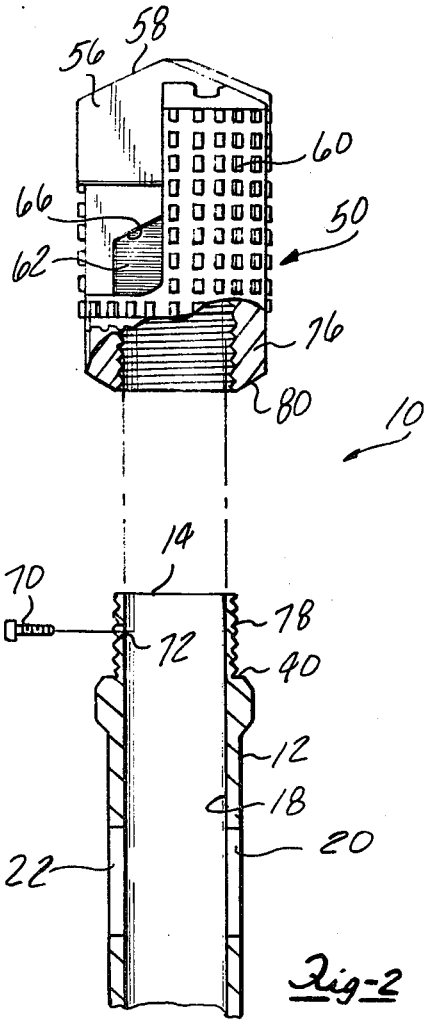
FIG. 2 is a partially sectioned, exploded, left hand side view, of the mining drill shown in FIG. 1.

Referring now to FIGS. 1 and 2 of the drawing, there is illustrated a mining drill 10 which is useful in forming holes in mine roofs in which a support bolt and expandable nut assembly is inserted to support the mine roof. The mining drill 10 is adapted to be mounted on any conventional drilling machine which provides rotary motion.

The mining drill 10 includes a shaft 12. The shaft 12 has an elongated, preferably, tubular form with first and second ends 14 and 16, respectively. A longitudinally extending bore 18 is formed within the shaft 12 and extends between the first and second ends 14 and 16.

At least one aperture 20 is formed in the shaft 12. The aperture 20 has an elongated, preferably slot-like form. In a preferred embodiment, a pair of apertures 20 and 22 are provided in a circumferentially spaced, co-planar manner. in the shaft 12. In addition, a plurality of pairs of apertures 20 and 22 are preferably arranged in a vertically spaced manner along the length of the shaft 12.

An annular collar 24 is mounted on shaft 12 adjacent to each aperture 20 or group of apertures 20 and 22. It is preferred that the collar 24 be integrally formed with the shaft 12. Each collar 24 has top and bottom surfaces 26 and 28, respectively.

The top surface 26 of the collar 24 is formed with an edge 30 which is spaced from the shaft 12. A downwardly extending inclined surface 32 extends from the edge 30 to the shaft 12 and forms an annular trap which collects dirt and debris generated during the drilling operation and directs the dirt and debris into the apertures 20 and 22 so as to remove such dirt and debris from the cutting area.

The bottom surface 28 of the collar 24 is provided with cutting means. Preferably, the cutting means is in the form of an edge 34 which spaced from the side wall of the shaft 12. An upwardly extending inclined surface 36 extends between the bottom edge 34 and the shaft 12. The bottom edge 34 thus defines a cutting edge. Alternately, a plurality of separate cutting teeth, not shown, may be formed along the bottom surface 28 of the collar 24 to provide the cutting means.

As shown in FIG. 1, a suitable mounting means or collar 38 is mounted on the shaft 12 adjacent the second end 16 of the shaft 12. The collar 38 provides a means for mounting the shaft 12 to the holder or chuck of a conventional drilling machine.

Further, the first end 14 of the shaft 12 is formed with an enlarged end portion which defines a shoulder 40 and is engageable by a cutting bit, as described hereafter.

The mining drill 10 of the present invention also includes a cutting bit 50 which is mountable on the first end 14 of the shaft 12. The cutting bit 50 has a substantially cylindrical form with an annular portion 52 and a tapered conical end portion 54.

The end portion 54 has a cross-wise extending slot, not shown, which receives and supports a cutting tip 56. The cutting tip 56 is preferably formed of a suitable high strength carbide alloy and is secured within the slot in the cutting bit 50 by suitable means, such as by welding. The cutting tip 56 is provided with a substantially v-shaped tapered surface 58 which acts as the primary cutting surface for the mining drill 10.

As shown in FIGS. 1 and 2, a plurality of cutting teeth 60 are formed in a circumferentially and longitudinally spaced manner on the annular portion 52 of the cutting bit 50. The cutting teeth 60 function to cut and size the hole during removal of the mining drill 10 from the hole.

The cutting bit 50 also includes an internal bore 62 which extends partially through the cutting bit 50 from one end of the cutting bit 50. The bore 62 is alignable with and communicates with the bore 18 in the shaft 12 when the cutting bit 50 is mounted on the first end of the shaft 12.

At least one and preferably a pair of apertures 64 and 66 are formed in the annular portion 52 of the cutting bit 50 and communicate with the interior bore 62 within the cutting bit 50. The apertures 64 and 66 are formed by cutting away a section of the annular portion 52 of the cutting bit 50 and function to direct dirt and debris generated during the cutting or drilling operation into the bore 62 for removal from the cutting area.

As shown in greater detail in FIG. 2, the mining drill 10 of the present invention is provided with means for fixedly attaching the cutting bit 50 on the first end of the shaft 12. In a preferred embodiment, the attaching means comprises a threaded fastener 70, such as a set screw, which is threadingly insertable through aligned bores 72 formed in the first end 14 of the shaft 12 and 74 formed in the bottom end of the cutting bit 50. The attaching means prevents separation of the cutting bit 50 from the shaft 12 regardless of the direction of rotation of the mining drill 10.

In order to mount the cutting bit 50 on the first end 14 of the shaft 12, a variety of attachment means can be employed. In a preferred embodiment, the cutting bit 50 is provided with a plurality of internal threads 76 formed at the end of the bore 62 in the cutting bit 50 which threadingly engage external threads 78 formed on the first and 14 of the shaft 12. In this manner, the cutting bit 50 engages and seats upon the shoulder 40 formed on the enlarged end portion of the shaft 12.

Optionally, the cutting bit 50 may be securely mounted on the first and 14 of the shaft 12 by welding. In this embodiment, the cutting bit 50 is provided with a tapered portion 80 adjacent the bottom end thereof. The tapered portion 80 forms an annular groove with the shoulder 40 on the shaft 12 for receiving the weld. Further, the cutting bit 50 could be integrally formed with the shaft 12 in a one-piece assembly.

Thus, there has been described a mining drill which is particularly useful in forming holes in mining roof operations. The drill includes a unique cutting bit having a cutting tip mounted therein. Apertures formed in the cutting bit communicate with an interior bore within the cutting bit which is aligned with and communicates with a corresponding bore formed in a shaft for removing dirt and debris generated during the drilling operation from the cutting area.

The shaft which receives the cutting bit at one end is provided with a longitudinally extending bore. At least one and preferably a plurality of pairs of circumferentially and vertically spaced apertures are formed along the shaft 12 in communication with the interior bore within the shaft. Collars integrally mounted on the shaft are provided with a downwardly tapered top surface and are disposed adjacent to each aperture for directing dirt and debris through the aperture into the bore within the shaft for removal of such dirt and debris from the cutting operation. Furthermore, the collars are provided with cutting means formed in the bottom surface thereof which function to size and shape the hole during removal of the mining drill from the hole.

The mining drill of the present invention functions to uniquely provide close hole tolerance and cencentricity during the drilling operation. Furthermore, the provision of cutting means on the collar spaced along the length of the shaft and the cutting teeth on the cutting bit provide additional hole sizing during removal of the drill from the hole which is particularly useful when wet conditions are encountered during the drilling operation which tend to cause hole shrinkage during drilling and after the drill is removed from the hole. In this manner, close hole tolerances can be maintained in all types of drilling conditions.

What is claimed is:

1. A mining drill mountable on a drilling machine comprising;

an elongated shaft having first and second ends and a bore extending longitudinally therethrough;

a cutting bit mountable on the first end of the shaft, the cutting bit having first and second ends;

a cutting tip mounted on the first end of the cutting bit;

a partial bore extending longitudinally through the cutting bit from the second end and aligned with the bore in the shaft;

a first aperture formed in the cutting bit in communication with the bore in the cutting bit for directing debris generated during the drilling operation into the aligned bores in the cutting bit and shaft;

a second aperture formed in the shaft and disposed in communication with the bore in the shaft; and an annular collar mounted on the shaft adjacent to the second aperture, the collar having a top edge spaced from the shaft and an inclined surface extending between the top edge and the shaft in communication with the second aperture for directing debris through the second aperture into the bore in the shaft.

2. The mining drill of claim 1 further including:

mating threads formed exteriorly on the first end portion of the shaft and interiorly in the bore adjacent the second end of the cutting bit for threadingly attaching the cutting bit to the first end of the shaft.

3. The mining drill of claim 1 further including means for fixedly attaching the cutting bit to the shaft for bi-directional rotation of the shaft and cutting bit.

4. The mining drill of claim 3 wherein the attaching means comprises:

a fastener threadingly extendable through aligned apertures formed in the cutting bit and the first end of the shaft.

5. The mining drill of claim 1 further including:

a plurality of cutting teeth formed about the periphery of the cutting bit between the first and second ends.

6. The mining drill of claim 1 further including a plurality of first apertures formed in the cutting bit and disposed in communication with the bore in the cutting bit.

7. The mining drill of claim 1 further including a plurality of circumferentially spaced second apertures formed in the shaft adjacent to the collar, each second aperture being disposed in communication with the bore in the shaft.

8. The mining drill of claim 1 further including:

cutting means formed on the bottom surface of the collar.

9. The mining drill of claim 8 wherein the cutting means includes a bottom edge formed on the collar and spaced from the shaft and a surface tapering from the bottom edge to the shaft, the bottom edge defining a cutting edge.

10. The mining drill of claim 1 further including a plurality of longitudinally spaced collars mounted on the shaft and second apertures formed in the shaft adjacent each collar.

11. A mining drill mountable on a drilling machine comprising:

an elongated shaft having first and second ends and a bore extending longitudinally therethrough;

a cutting bit mountable on the first end of the shaft, the cutting bit having first and second ends;

mating threads formed exteriorly on the first end portion of the shaft and interiorly in the bore adjacent the second end of the cutting bit for threadingly attaching the cutting bit to the first end of the shaft;

a fastener threadingly extendable through aligned apertures formed in the cutting bit and the first end of the shaft for fixedly attaching the cutting bit to the shaft for bi-directional rotation of the shaft and cutting bit:

a plurality of cutting teeth formed about the periphery of the cutting bit between the first and second end;

a cutting tip mounted on the first end of the cutting bit;

a partial bore formed in the cutting bit and extending longitudinally through the cutting bit from the second end and aligned with the bore in the shaft;

a first aperture formed in the cutting bit in communication with the bore in the cutting bit for directing debris into the bore in the cutting bit;

a plurality of second apertures formed in the shaft in communication with the bore in the shaft;

a plurality of collars mounted on the shaft adjacent to at least one of the second apertures, the collars having top and bottom surfaces, the top surface having a top edge spaced from the shaft and a downwardly-extending, inclined surface extending from the top edge to the shaft in communication with the second apertures for directing debris through the second apertures into the bore in the shaft, the bottom surface having a bottom edge forming a cutting means on the collar.

* * * * *